US011074898B1

(12) United States Patent
Boxberger

(10) Patent No.: US 11,074,898 B1
(45) Date of Patent: Jul. 27, 2021

(54) STRINGED INSTRUMENT WITH AN INTERCHANGEABLE MAGNETIC PICKUP SYSTEM

(71) Applicant: Frank Dale Boxberger, Scottsdale, AZ (US)

(72) Inventor: Frank Dale Boxberger, Scottsdale, AZ (US)

( * ) Notice: Subject to any disclaimer, the term of this patent is extended or adjusted under 35 U.S.C. 154(b) by 19 days.

(21) Appl. No.: 16/799,695

(22) Filed: Feb. 24, 2020

Related U.S. Application Data

(60) Provisional application No. 62/810,862, filed on Feb. 26, 2019.

(51) Int. Cl.
*G10H 3/18* (2006.01)
*G10D 1/08* (2006.01)

(52) U.S. Cl.
CPC ..... *G10H 3/181* (2013.01); *G10D 1/085* (2013.01); *G10H 3/183* (2013.01); *G10H 2220/505* (2013.01); *G10H 2220/521* (2013.01)

(58) Field of Classification Search
CPC ..... G10H 3/18; G10H 3/181; G10H 3/186; G10H 1/00; G10H 1/348; G10H 2220/521; G10H 3/143; G10H 1/32; G10H 3/22; G10H 1/20; G10H 3/182; G10H 1/34; G10H 1/18; G10H 2220/461; G10H 2220/485; G10D 1/085
See application file for complete search history.

(56) References Cited

U.S. PATENT DOCUMENTS

| | | | | |
|---|---|---|---|---|
| 6,034,316 | A * | 3/2000 | Hoover | G10H 3/186 84/738 |
| 6,253,654 | B1 * | 7/2001 | Mercurio | G10D 1/085 84/267 |
| 9,715,868 | B2 * | 7/2017 | Brzykcy | G10D 1/085 |
| 9,728,175 | B2 | 8/2017 | Strassell | |
| 10,311,851 | B1 | 6/2019 | Stadnyk | |
| 10,923,093 | B1 * | 2/2021 | Micek | G10H 3/183 |
| 2004/0107822 | A1 * | 6/2004 | Olvera | G10H 3/182 84/743 |
| 2012/0036983 | A1 * | 2/2012 | Ambrosino | G10H 3/183 84/731 |
| 2015/0356955 | A1 * | 12/2015 | Brown, Jr. | G10H 3/18 84/267 |

(Continued)

*Primary Examiner* — Marlon T Fletcher
(74) *Attorney, Agent, or Firm* — Plager Schack LLP; Mark H. Plager; Eric Liou

(57) ABSTRACT

A stringed instrument with an interchangeable magnetic pickup system to enable any number of a plurality of pickups to attach to the instrument in variable positions is provided. The stringed instrument includes a base with a central opening, a plurality of strings coupled to the base and extending over the central opening, a main magnetic mounting plate coupled to the base within the central opening and electrically coupled to a phono plug output of the base, a plurality of secondary magnetic mounting plates coupled to the base within the central opening and electrically coupled to the phono plug output of the base, and a plurality of pickup assemblies coupled to the base. Each pickup assembly has a first magnetic member electrically coupled to one of the secondary magnetic mounting plates and a second magnetic member electrically coupled to the main magnetic mounting plate.

12 Claims, 5 Drawing Sheets

(56) References Cited

U.S. PATENT DOCUMENTS

| | | | | |
|---|---|---|---|---|
| 2016/0027422 | A1* | 1/2016 | Baker | G10H 3/22 84/726 |
| 2017/0025102 | A1* | 1/2017 | Brown, Jr. | G10H 3/18 |
| 2018/0061389 | A1 | 3/2018 | Berg | |
| 2019/0108823 | A1* | 4/2019 | Palmieri | G10D 1/085 |
| 2020/0365119 | A1* | 11/2020 | Reddick | G10H 3/183 |

* cited by examiner

STRINGED INSTRUMENT WITH AN INTERCHANGEABLE MAGNETIC PICKUP SYSTEM

RELATED APPLICATION

The application claims priority to provisional patent application U.S. Ser. No. 62/810,862 filed on Feb. 26, 2019, the entire contents of which is herein incorporated by reference.

BACKGROUND

The embodiments herein relate generally to musical stringed instruments. More specifically, embodiments of the invention are directed to a stringed instrument with an interchangeable magnetic pickup system.

Musical stringed instruments such as guitars and bass guitars often use multiple pickups on the body of the instrument to capture vibrations of the strings, which are transmitted as sound signals through an electric cord to an amplifier. The amplifier enhances the strength of the sound signals, which are delivered to a speaker to generate audible sounds. The generated sound of the stringed instrument can vary depending on the type of pickup used, its location on the instrument body and angle of orientation relative to the strings of the instrument. Therefore, it is desirable for musicians and music technicians to have the ability to add, remove and/or interchange any number of pickups on the stringed instrument.

Several changeable pickup systems for stringed instruments exist as disclosed in U.S. Patent Application Publication 2018/0061389, and U.S. Pat. Nos. 10,311,851 and 9,728,175. However, these changeable pickup systems are limited for one or more of the following reasons: (1) the pickups are mechanically fastened to a cartridge that attaches to the instrument in a single position, which does not allow for the pickups to be moved or rotated relative to the instrument's strings; (2) the changeable pickup system comprises complicated components that are expensive to manufacture and inefficient to use; and/or (3) the strings of the instrument have to be loosened, detuned and/or removed in order to access space in the instrument to change any of the pickups, thereby rendering the pickup system inefficient.

As such, there is a need in the industry for a simple and cost-effective stringed instrument with an interchangeable magnetic pickup system that addresses the limitations of the prior art, which allows pickups to be easily attached and/or detached from the instrument with enhanced efficiency. There is a need for the instrument and magnetic pickup system to allow each pickup to be attached to different locations on the instrument. There is a further need for the instrument and magnetic pickup system to allow for each attached pickup to be rotated to vary the angle of the pickup relative to the strings of the instrument to achieve the desired sound.

SUMMARY

In certain embodiments, a stringed instrument with an interchangeable magnetic pickup system to enable any number of a plurality of pickups to attach to the instrument in variable positions is provided. The stringed instrument comprises a base comprising a front face, a rear face opposite the front face, and a central opening disposed therethrough, the central opening comprising an upper opening continuously connected to a lower opening, the upper opening comprising a first cross-sectional area and extending from the front face of the base to an intermediate portion of the base, the lower opening comprising a second cross-sectional area and extending from the intermediate portion of the base to the rear face of the base, a plurality of strings coupled to the front face of the base and extending over the central opening in the base, a main magnetic mounting plate coupled to the base within the central opening and electrically coupled to a phono plug output of the base, a plurality of secondary magnetic mounting plates coupled to the base within the central opening, each secondary magnetic mounting plate in the plurality of secondary magnetic mounting plates electrically coupled to the phono plug output of the base, and a plurality of pickup assemblies coupled to the base, each pickup assembly in the plurality of pickup assemblies comprising a magnetic pickup electrically coupled to a first magnetic member and a second magnetic member, the first magnetic member of the pickup assembly electrically coupled to one of the secondary magnetic mounting plates and the second magnetic member of the pickup assembly electrically coupled to the main magnetic mounting plate, wherein sound signals generated from each pickup assembly in the plurality of pickup assemblies transmit from the first and second magnetic members of the pickup assembly through one of the secondary magnetic mounting plates and main magnetic mounting plate on the base to the phono plug output of the base.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 2:
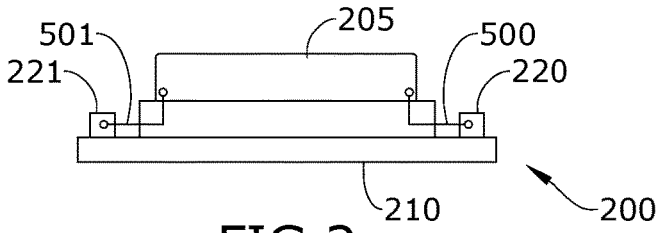
FIG. 2 depicts a schematic view of certain embodiments of the stringed instrument with an interchangeable magnetic pickup system illustrating the side of a pickup assembly.
Figure 3:
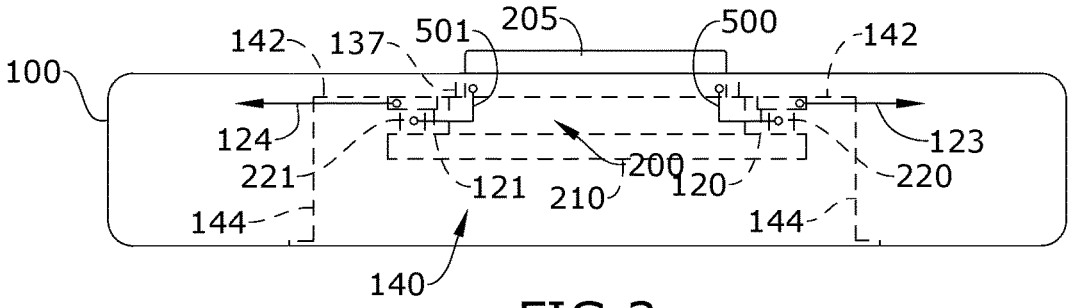
FIG. 3 depicts a schematic view of certain embodiments of the stringed instrument with an interchangeable magnetic pickup system illustrating the pickup assembly coupled to the instrument.
Figure 4:
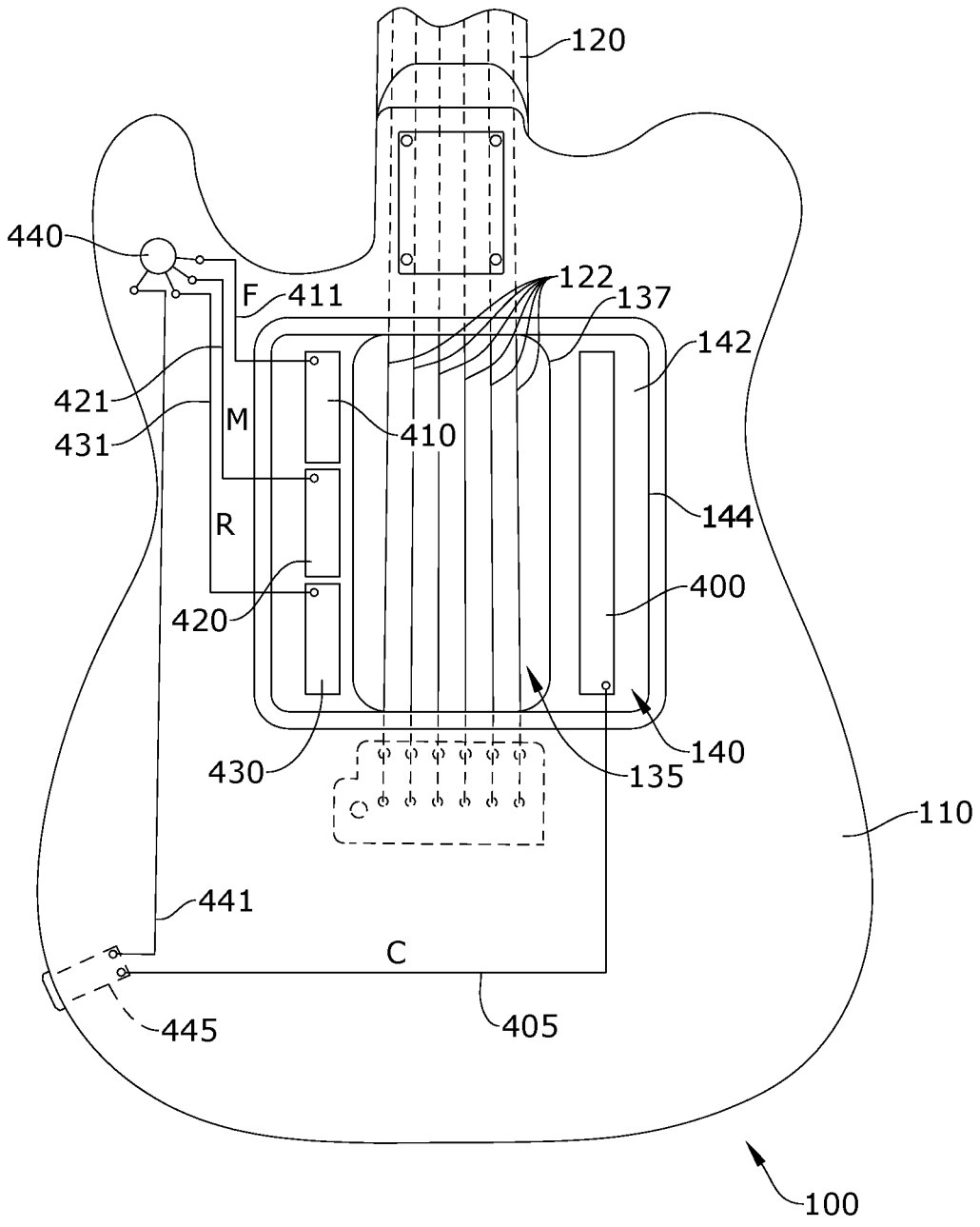
FIG. 4 depicts a schematic view of certain embodiments of the stringed instrument with an interchangeable magnetic pickup system illustrating the rear of the instrument.
Figure 9:
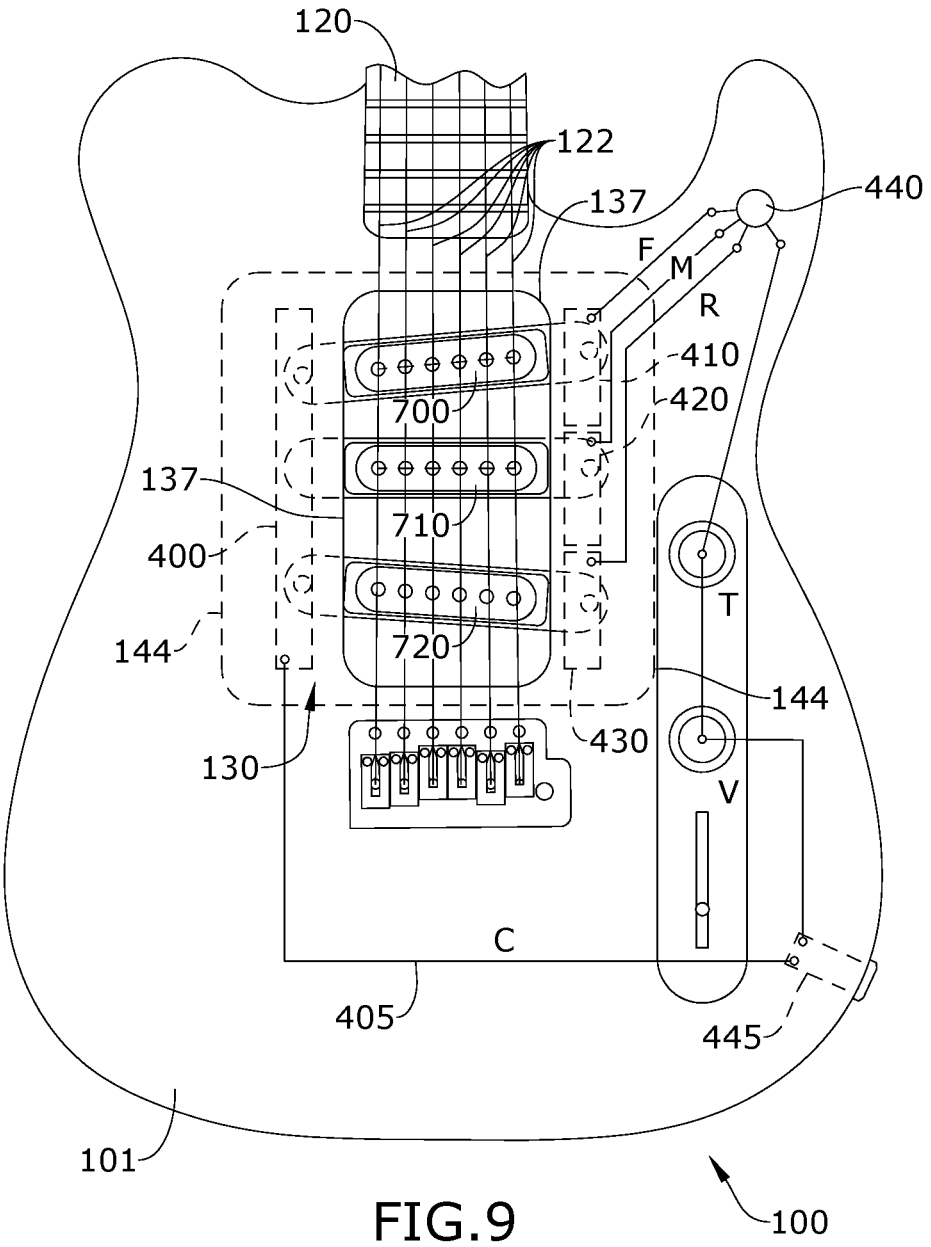
FIG. 9 depicts a schematic view of certain embodiments of the stringed instrument with an interchangeable magnetic pickup system illustrating the front of the instrument shown in use.

In certain embodiments as depicted in FIGS. 1-4 and 9, a stringed instrument with an interchangeable magnetic pickup system generally comprises a plurality of pickup assemblies 200 that are configured to attach and detach to the base of the instrument. In one embodiment as depicted in FIGS. 4 and 9, the stringed instrument comprises an electric guitar having a body that includes base 100 with top surface 101, side surface 105 and bottom surface 110, and neck 120. A plurality of strings 122 are coupled to top surface 101 of base 100 and neck 120 as is known in the field. Although the figures depict the instrument as an electric guitar, it shall be appreciated that the interchangeable pickup system disclosed herein can be used with a bass guitar or any other stringed instrument in alternative embodiments.

Figure 1:
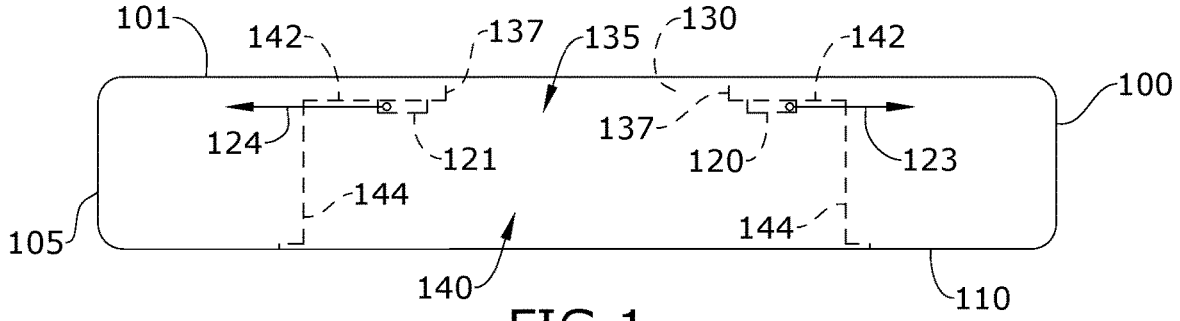
FIG. 1 depicts a schematic end view of certain embodiments of the stringed instrument with an interchangeable magnetic pickup system.

In one embodiment as depicted in FIG. 1, base 100 of the stringed instrument comprises central opening 130 that extends therethrough from top surface 101 to bottom surface 110. In one embodiment, central opening 130 is formed by upper opening 135, which is continuously connected to lower opening 140. Upper opening 135 extends from top surface 101 to an intermediate portion of base 100, and is defined by top side wall 137. Lower opening 140 extends from the intermediate portion of base 100 to bottom surface 110, and is defined by top inner wall 142 and bottom side wall 144. In one embodiment, lower opening 140 comprises a cross-sectional area that is larger than the cross-sectional area of upper opening 135.

In one embodiment as depicted in FIG. 1, main magnetic mounting plate 121 and secondary magnetic mounting plate 120 are coupled to top inner wall 142 of lower opening 140 in base 100. Main magnetic mounting plate 121 and secondary magnetic mounting plate 120 are configured to detachably couple to corresponding contacts on each pickup assembly 200 as will be described in more detail in the following embodiments. Main magnetic mounting plate 121 and secondary magnetic mounting plate 120 are electrically coupled to first and second wires 123, 124, which are mounted within the stringed instrument and are connected to phono plug output 445 of the instrument as depicted in FIG. 4.

In a preferred embodiment, main magnetic mounting plate 121 and secondary magnetic mounting plate 120 are made from steel. However, main magnetic mounting plate 121 and secondary magnetic mounting plate 120 can be made from another material including, but not limited to, any type of magnet, iron, nickel, cobalt or any other ferromagnetic metal that is attracted to a magnetic force.

Figure 5:
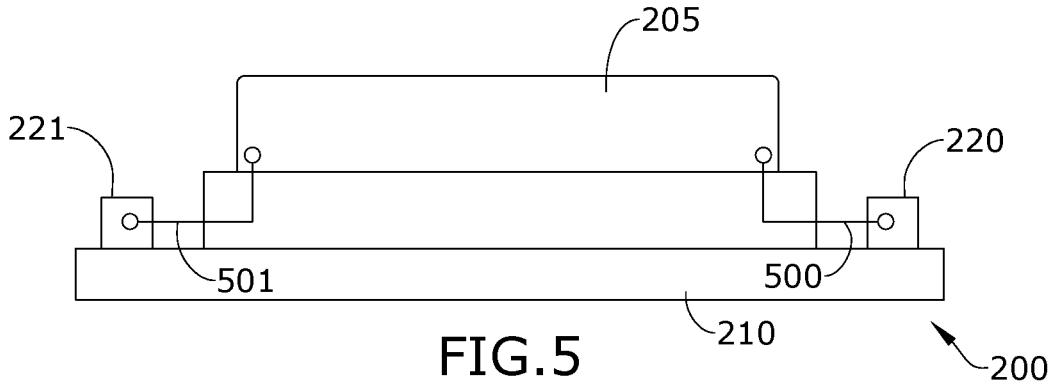
FIG. 5 depicts a schematic view of certain embodiments of the stringed instrument with an interchangeable magnetic pickup system illustrating the side of the pickup assembly.

In one embodiment as depicted in FIGS. 2 and 5, each pickup assembly 200 generally comprises pickup 205, base plate 210, first magnetic member 220 and second magnetic member 221. Pickup 205 is coupled to base plate 210 and can be a single-coil pickup or dual-coil pickup as is known in the field. Base plate 210 is preferably made from plastic, but alternative materials known in the field can be used instead. In one embodiment, pickup 205 and base plate 210 are separated from each other by a spacer. First and second magnetic members 220, 221 are coupled to base plate 210 and are electrically coupled to pickup 205 by first and second connecting wires 500, 501.

First and second magnetic members 220, 221 can be any type of magnet known in the field. In one embodiment, first and second magnetic members 220, 221 are rare earth magnets such as neodymium. In an alternative embodiment, first and second magnetic members 220, 221 can be made from any ferromagnetic metal.

In one embodiment as depicted in FIG. 3, pickup assembly 200 is configured to couple to base 100 of the instrument within central opening 130. In this embodiment, first and second magnetic members 220, 221 engage with main magnetic mounting plate 121 and secondary magnetic mounting plate 120 of the stringed instrument. The magnetic attraction between first and second magnetic members 220, 221 and main magnetic mounting plate 121 and secondary magnetic mounting plate 120 secure pickup assembly 200 in place to the stringed instrument. Further, sound signals generated from pickup assembly 200 transmit from first and second magnetic members 220, 221 of the pickup assembly through main magnetic mounting plate 121 and secondary magnetic mounting plate 120 on the instrument to phono plug output 445 of base 100.

In one embodiment, each magnetic member in first and second magnetic members 220, 221 are enclosed by an outer steel layer. In one embodiment, the outer steel layer is coupled to the magnetic member by epoxy. These steel encased magnetic members are advantageous for the following reasons: (1) the outer steel layer protects the neodymium magnet or other type of magnet from shattering, cracking or chipping; and (2) the epoxy layer between the magnetic member and steel layer serves as a shield that blocks the magnetic field present, thereby minimizing any interference or undesirable hum to the sound generated by the stringed instrument.

In many instances, it is desirable to attach multiple pickup assemblies 200 to the stringed instrument. In order to accommodate the additional pickup assemblies 200, additional magnetic mounting plates are coupled to base 100 of the instrument. In one embodiment as depicted in FIG. 4, alternate main magnetic mounting plate 400 is coupled to top inner wall 142 in lower opening 140 of base 100. Alternate main magnetic mounting plate 400 serves as a common connection plate for all attached pickup assemblies and is electrically coupled to phono plug output 445 by common wire 405.

In one embodiment, a plurality of secondary magnetic mounting plates including front secondary magnetic mounting plate 410, middle secondary magnetic mounting plate 420 and rear secondary magnetic mounting plate 430 are coupled to top inner wall 142 in lower opening 140 of base 100. Front, middle and rear secondary magnetic mounting plates 410, 420, and 430 are electrically coupled to 5-way pickup switch 440 by corresponding front, middle and rear wires 411, 421, 431. The 5-way pickup switch 440 is electrically coupled to phono plug output 445 by output wire 441.

In a preferred embodiment, front, middle and rear secondary magnetic mounting plates 410, 420, 430 and alternate main magnetic mounting plate 400 are made from steel. However, these magnetic mounting plates can be made from another material including, but not limited to, any type of magnet, iron, nickel, cobalt or any other ferromagnetic metal that is attracted to a magnetic force.

In one embodiment as depicted in FIGS. 4 and 9, front pickup assembly 700, middle pickup assembly 710 and rear pickup assembly 720 are coupled to their corresponding magnetic mounting plates on the instrument and comprise the same components as pickup assembly 200 previously described in embodiments of the invention.

Specifically, first and second magnetic members 220, 221 of front pickup assembly 700 engage with alternate main magnetic mounting plate 400 and front secondary magnetic mounting plate 410 of the stringed instrument. First and second magnetic members 220, 221 of middle pickup assembly 710 engage with alternate main magnetic mounting plate 400 and middle secondary magnetic mounting plate 420 of the stringed instrument. First and second magnetic members 220, 221 of rear pickup assembly 720 engage with alternate main magnetic mounting plate 400 and rear secondary magnetic mounting plate 430 of the stringed instrument.

The sound generated from any activated pickup assembly 700, 710, 720 transmits from first and second magnetic members 220, 221 of the pickup assembly through the corresponding connected magnetic mounting plates on the instrument to phono plug output 445 of base 100. Phono plug output 445 on the instrument is coupled to an amplifier (not shown) as is known in the field. In one embodiment, 5-way switch 440 on base 100 of the instrument can be adjusted to the desired position to enable different combinations of the pickup assemblies 700, 710, 720 to be activated to achieve the desired sound.

Figure 6:
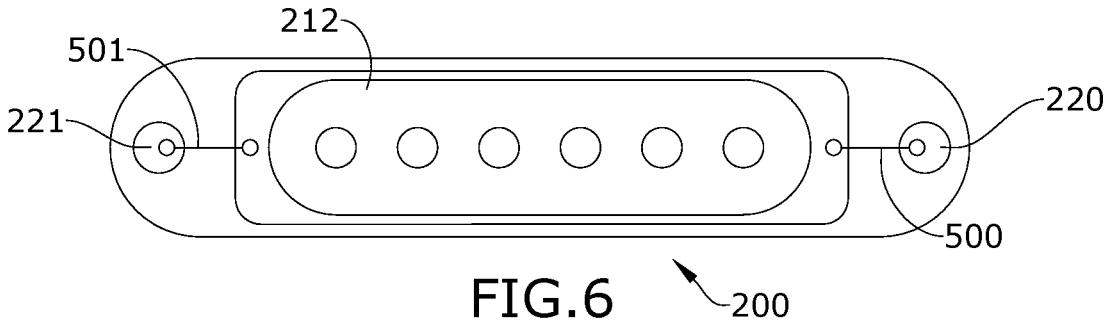
FIG. 6 depicts a schematic view of certain embodiments of the stringed instrument with an interchangeable magnetic pickup system illustrating the pickup assembly as a single-coil pickup.
Figure 7:
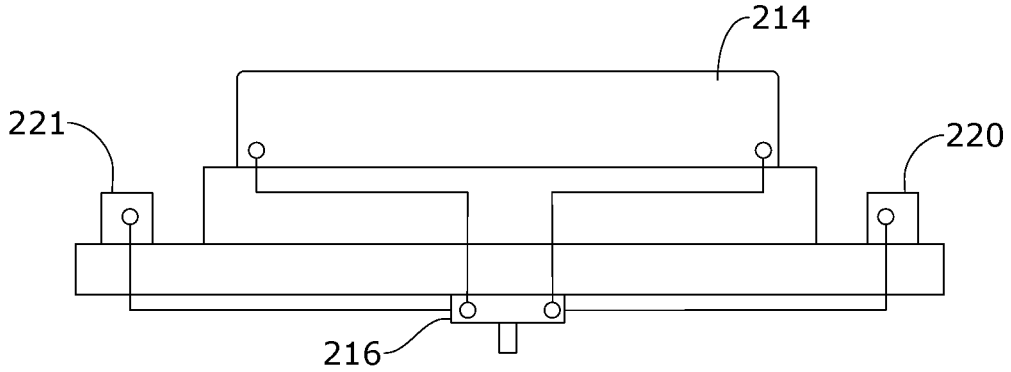
FIG. 7 depicts a schematic view of certain embodiments of the stringed instrument with an interchangeable magnetic pickup system illustrating a side view of the pickup assembly as a dual-coil pickup.
Figure 8:
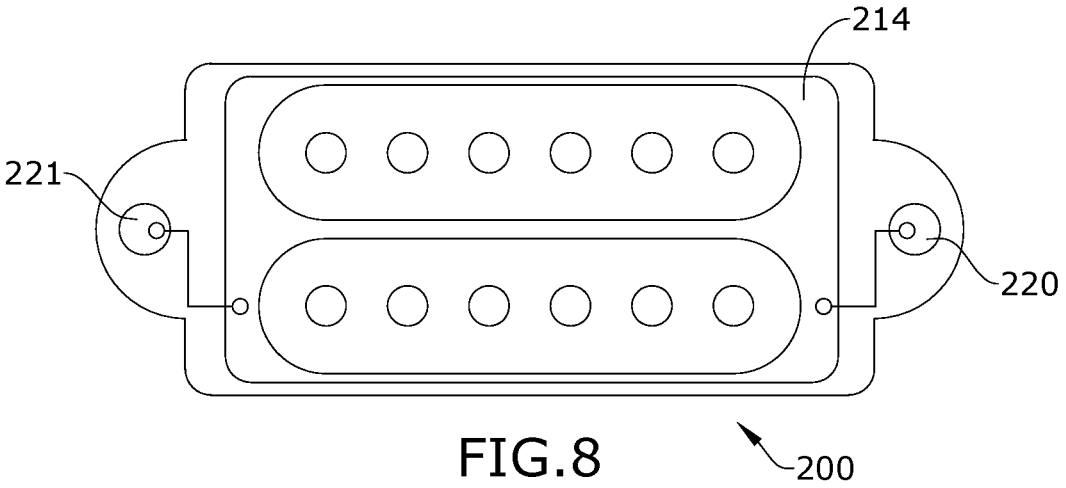
FIG. 8 depicts a schematic view of certain embodiments of the stringed instrument with an interchangeable magnetic pickup system illustrating the pickup assembly as a dual-coil pickup.

In certain embodiments, the pickups in pickup assemblies 700, 710, 720 can include any combination of single-coil pickup 212 as depicted in FIG. 6 or dual-coil pickup 214 as depicted in FIGS. 7-8. In one embodiment, 4-way switch 216 is electrically coupled to dual-coil pickup 214 and first and second magnetic members 220, 221 of the pickup assembly. In one embodiment, 4-way switch 216 is configured to adjust to one of a plurality of modes to control the operation of the dual-coil pickup: (1) single coil to achieve a gritty and sharp sound; (2) double-coil in parallel to achieve a sharp but smooth sound; (3) double-coil in series to achieve a smooth sound; and (4) double-coil out-of-phase to achieve a similar sound to a 12-string guitar.

Figure 10:
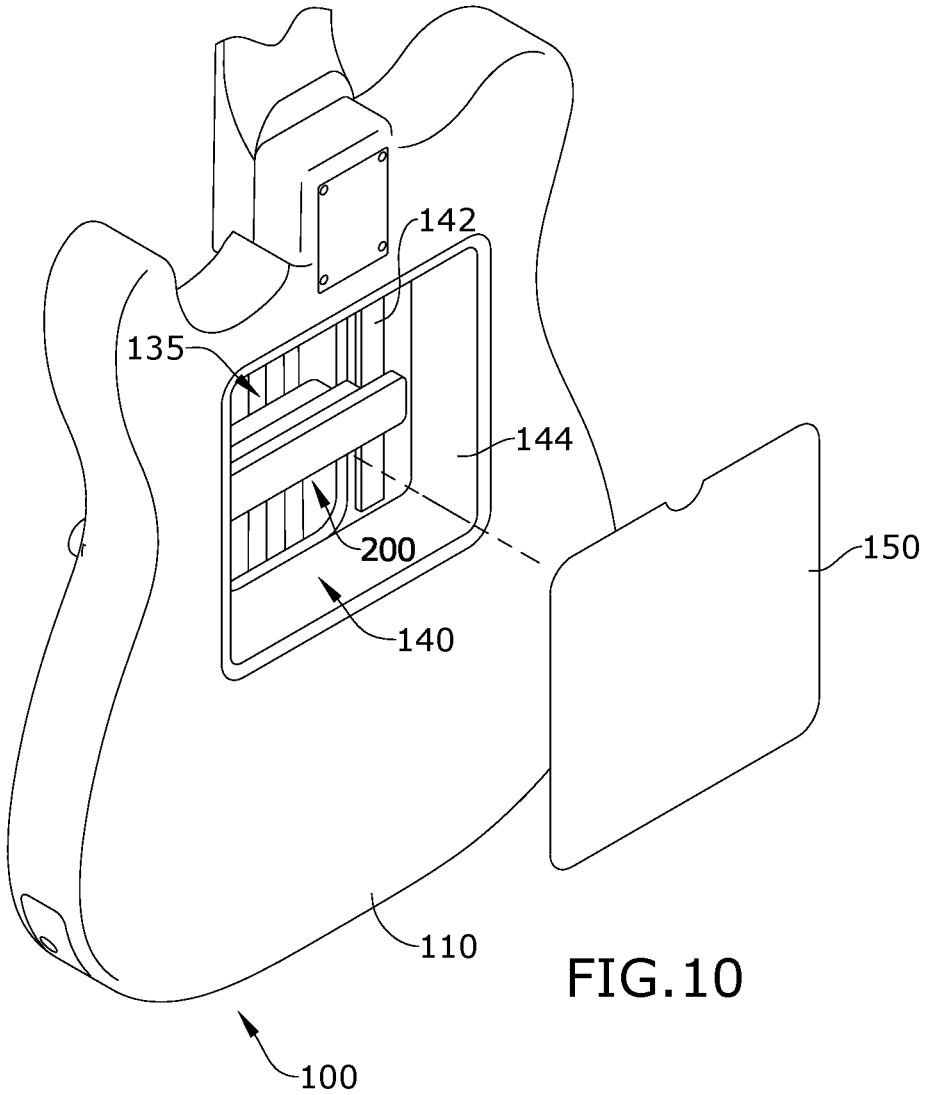
FIG. 10 depicts a perspective view of certain embodiments of the stringed instrument with an interchangeable magnetic pickup system illustrating the rear of the instrument.

In one embodiment as depicted in FIG. 10, back plate 150 is configured to couple to bottom surface 110 of base 100 to seal central opening 130. In one embodiment, back plate 150 comprises a series of magnetic members that detachably couple to corresponding magnetic members in base 100. In an alternative embodiment, other snap components or fasteners can be used to allow back plate 150 to easily attach and detach from base 100 of the instrument. With back plate 150 removed from base 100 of the instrument, a user can easily reach in central opening 130 of base 100 from the rear of the instrument to easily add, remove and/or adjust the orientation of any pickup assembly 200 in the stringed instrument.

The stringed instrument with an interchangeable magnetic pickup system as described in embodiments of the invention has several advantages over the prior art. The user can easily attach and detach pickup assemblies through central opening 130 of base 100 with enhanced efficiency. Since the user attaches and detaches the pickup assemblies through the rear of the stringed instrument, the plurality of strings 122 of the instrument do not have to be loosened and/or detuned to facilitate the adjustments as in the prior art.

As depicted in FIG. 9, the rounded corners of pickup assemblies 700, 710, 720 allow the user to easily rotate each pickup assembly to adjust the angle formed by the longitudinal axis of the pickup assembly and the central axes of the plurality of strings 122 of the instrument. These rotational adjustments can be performed with pickup assemblies 700, 710, 720 to vary the sound generated by the instrument.

Further, first and second magnetic members 220, 221 of each pickup assembly 700, 710, 720 can engage with the main magnetic mounting plate and secondary magnetic mounting plate, or with the pickup assembly rotated 180 degrees to engage first and second magnetic members 220, 221 with the main magnetic mounting plate and secondary magnetic mounting plate in the opposite orientation, to allow any pickup assembly to generate sound signals corresponding to either in-phase or out-of-phase sounds.

In alternative embodiments, it shall be appreciated that the interchangeable magnetic pickup system can be modified to include any alternative number of secondary magnetic mounting plates to accommodate any alternative number of pickup assemblies as desired.

It shall be appreciated that the components of the stringed instrument with an interchangeable magnetic pickup system described in several embodiments herein may comprise any alternative known materials in the field and be of any color, size and/or dimensions. It shall be appreciated that the components of the stringed instrument with an interchangeable magnetic pickup system described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A stringed instrument with an interchangeable magnetic pickup system to enable any number of a plurality of pickups to attach to the instrument in variable positions, the stringed instrument comprising:

a base comprising a front face, a rear face opposite the front face, and a central opening disposed therethrough, the central opening comprising an upper opening continuously connected to a lower opening, the upper opening comprising a first cross-sectional area and extending from the front face of the base to an intermediate portion of the base, the lower opening comprising a second cross-sectional area and extending from the intermediate portion of the base to the rear face of the base;

a plurality of strings coupled to the front face of the base and extending over the central opening in the base;

a main magnetic mounting plate coupled to the base within the central opening and electrically coupled to a phono plug output of the base;

a plurality of secondary magnetic mounting plates coupled to the base within the central opening, each secondary magnetic mounting plate in the plurality of secondary magnetic mounting plates electrically coupled to the phono plug output of the base; and a plurality of pickup assemblies coupled to the base, each pickup assembly in the plurality of pickup assemblies comprising a magnetic pickup electrically coupled to a first magnetic member and a second magnetic member, the first magnetic member of the pickup assembly electrically coupled to one of the secondary magnetic mounting plates and the second magnetic member of the pickup assembly electrically coupled to the main magnetic mounting plate;

wherein sound signals generated from each pickup assembly in the plurality of pickup assemblies transmit from the first and second magnetic members of the pickup assembly through one of the secondary magnetic mounting plates and main magnetic mounting plate on the base to the phono plug output of the base.

2. The stringed instrument of claim 1, wherein each pickup assembly in the plurality of pickup assemblies is configured to rotate to adjust an angle formed by a longitudinal axis of the pickup assembly and central axes of the plurality of strings.

3. The stringed instrument of claim 2, wherein the second cross-sectional area of the lower opening is greater than the first cross-sectional area of the upper opening.

4. The stringed instrument of claim 3, wherein each pickup assembly in the plurality of pickup assemblies comprises a base plate coupled to the magnetic pickup, the first and second magnetic members of the pickup assembly being coupled to the base plate.

5. The stringed instrument of claim 4, wherein the plurality of secondary magnetic mounting plates comprises a front secondary magnetic mounting plate, a middle secondary magnetic mounting plate and a rear secondary magnetic mounting plate.

6. The stringed instrument of claim 5, wherein the plurality of pickup assemblies comprises a first pickup assembly, a second pickup assembly and a third pickup assembly, the first magnetic member of the first pickup assembly electrically coupled to the front secondary magnetic mounting plate and the second magnetic member of the first pickup assembly electrically coupled to the main magnetic mounting plate, the first magnetic member of the second pickup assembly electrically coupled to the middle secondary magnetic mounting plate and the second magnetic member of the second pickup assembly electrically coupled to the main magnetic mounting plate, and the first magnetic member of the third pickup assembly electrically coupled to the rear secondary magnetic mounting plate and the second magnetic member of the third pickup assembly electrically coupled to the main magnetic mounting plate.

7. The stringed instrument of claim 6, wherein the magnetic pickup of one of the pickup assemblies in the plurality of pickup assemblies comprises a dual-coil pickup, the one of the pickup assemblies comprising a 4-way switch electrically coupled to the dual-coil pickup.

8. The stringed instrument of claim 6, further comprising a 5-way switch coupled to the base, the 5-way switch electrically coupled to the phono plug output, and the front, middle and rear secondary magnetic mounting plates.

9. The stringed instrument of claim 8, wherein each magnetic member in the first and second magnetic members of each pickup assembly is a neodymium magnet that is enclosed by a steel layer.

10. A stringed instrument with an interchangeable magnetic pickup system to enable a pickup to attach to the instrument in variable positions, the stringed instrument comprising:

a base comprising a front face, a rear face opposite the front face, and a central opening disposed through the base, the central opening comprising an upper opening continuously connected to a lower opening, the upper opening comprising a first cross-sectional area and extending from the front face of the base to an intermediate portion of the base, the lower opening comprising a second cross-sectional area and extending from the intermediate portion of the base to the rear face of the base;

a plurality of strings coupled to the front face of the base and extending over the central opening in the base;

a main magnetic mounting plate coupled to the base within the central opening and electrically coupled to a phono plug output of the base;

a secondary magnetic mounting plate coupled to the base within the central opening and electrically coupled to the phono plug output of the base; and a pickup assembly coupled to the base and comprising a magnetic pickup electrically coupled to a first magnetic member and a second magnetic member, the first magnetic member of the pickup assembly electrically coupled to the secondary magnetic mounting plate and the second magnetic member of the pickup assembly electrically coupled to the main magnetic mounting plate;

wherein sound signals generated from the pickup assembly transmit from the first and second magnetic members of the pickup assembly through the secondary magnetic mounting plate and main magnetic mounting plate on the base to the phono plug output of the base, wherein the pickup assembly is configured to rotate to adjust an angle formed by a longitudinal axis of the pickup assembly and central axes of the plurality of strings.

11. The stringed instrument of claim 10, wherein the second cross-sectional area of the lower opening is greater than the first cross-sectional area of the upper opening.

12. The stringed instrument of claim 11, wherein each magnetic member in the first and second magnetic members of the pickup assembly is a neodymium magnet that is enclosed by a steel layer.

* * * * *